United States Patent [19]

Rasmussen

[11] Patent Number: 4,848,588

[45] Date of Patent: Jul. 18, 1989

[54] FEMININE SUPPLIES STORAGE CONTAINER

[76] Inventor: Sharon L. Rasmussen, 6417 Standish Ave. S., Richfield, Minn. 55423

[21] Appl. No.: 158,930

[22] Filed: Feb. 22, 1988

[51] Int. Cl.[4] ..... B65D 69/00

[52] U.S. Cl. ..... 206/581; 206/223; 206/561; 206/570; 220/20; 220/22; 220/22.1; 220/345

[58] Field of Search ..... 206/38, 223, 569, 570, 206/581, 561, 823; 220/20, 21, 22, 22.1, 23.1, 252, 345, 346, 353, 355

[56] References Cited

U.S. PATENT DOCUMENTS

| | | | |
|---|---|---|---|
| 417,979 | 12/1889 | Borcherdt | 220/23 |
| 1,421,645 | 7/1922 | Wilson | 220/20 |
| 1,507,915 | 9/1924 | Goldsmith | 206/581 |
| 1,661,728 | 3/1928 | La Rue | 220/20 |
| 1,944,502 | 1/1934 | Factor | 220/20 |
| 2,013,281 | 9/1935 | McCalla | 206/38 |
| 2,062,973 | 12/1936 | Gluckstein | 206/570 |
| 2,175,949 | 10/1939 | Allen | 220/20 |
| 2,410,928 | 11/1946 | Christner et al. | 206/569 |
| 2,553,971 | 5/1951 | Hunter | 220/20 |
| 2,584,435 | 2/1952 | Doerr | 220/20 |
| 2,589,349 | 3/1952 | Diefenbach . | |
| 2,663,449 | 12/1953 | Smart . | |
| 2,740,516 | 4/1956 | Renn | 206/38 R |
| 3,200,983 | 8/1965 | Walter | 220/22 |
| 3,258,017 | 6/1966 | Albert | 206/581 |
| 3,362,564 | 1/1968 | Mueller | 220/346 |
| 3,732,955 | 5/1973 | Carter et al. | 220/23 |
| 3,823,817 | 7/1974 | Hughes | 220/20 |
| 3,909,092 | 9/1975 | Kiernan | 220/20 |
| 4,261,464 | 4/1981 | Maitland . | |
| 4,342,403 | 8/1982 | Badtke et al. . | |
| 4,499,997 | 2/1985 | Swingley, Jr. . | |
| 4,615,461 | 10/1986 | Liu . | |

FOREIGN PATENT DOCUMENTS

| | | | |
|---|---|---|---|
| 564785 | 10/1923 | France | 206/38 |

*Primary Examiner*—David T. Fidei
*Attorney, Agent, or Firm*—Robert C. Baker

[57] ABSTRACT

This invention provides a compact storage container formed of a base member and a slidably removable cover. The base member is subdivided into a relatively larger first part and a smaller second part which is further subdivided for particular feminine supplies. The largest part or compartment may optionally be subdivided by means of a movable divider panel. The base member has lateral flanges which project outwardly from its opposing side walls at the uppermost edge thereof. The flanges provide slideways for the slidably removable cover.

8 Claims, 2 Drawing Sheets

FEMININE SUPPLIES STORAGE CONTAINER

BACKGROUND OF THE INVENTION

This invention relates to a feminine supplies storage container with a slidably removable cover having an interior recess. The invention uniquely combines feminine care articles in a compact displayable container while at the same time maintaining privacy and concealment for the articles. The slidably removable cover saves against accidental bumping removal of it but provides easy access to the interior organized storage of the feminine supplies.

The storage container provides storage areas of selected sizes and optionally variable sizes to accommodate a variety of feminine supply items, such as for example, a marking instrument or pencil, a thermometer, a date calendar, a contraceptive diaphragm, sanitary menstrual supplies and the like. Preferably the container is molded out of organic plastic material.

Others have heretofore proposed containers designed for specific article storage. However, no known previously proposed containers provide compact compartmentalized storage for a multitude of feminine supplies in the manner taught by this invention; and no known previously proposed containers provide private storage in a slidably removable cover as taught herein. Further, insofar as is known, no one has previously proposed a compact organized feminine supplies storage container of discrete yet decorative character suitable for display at convenient usage location such as, for example, on the top of a toilet tank, or on a bathroom or vanity counter top, or on a bedside stand or the like.

SUMMARY OF THE INVENTION

This invention provides a compact storage container formed of a base member and a slidably removable cover. The base member is subdivided into a relatively larger first part and a smaller second part which is further subdivided for particular feminine supplies. The largest part or compartment may optionally be subdivided by means of a movable divider panel. The base member has lateral flanges which project outwardly from its opposing side walls at the uppermost edge thereof. The flanges provide slideways for the slidably removable cover.

The cover bulges or projects upwardly from its perimeter edge, thereby forming an upwardly extending interior recess within it. Items such as a marking instrument or a date calendar may be stored in the recess of the cover and suitably releaseably held therein by clip members or other holder means. In a preferred embodiment, the cover includes a tray member united to a movable wall portion of the cover. U-shaped track channels fixed at the cover perimeter edges of opposing cover side walls receive the flanges on the base member as the cover is slidably placed over the base member to serve as a closure.

Ideally, the base member and cover forming the container are molded out of organic plastic material of a form-retaining character such as, for example, polystyrene, suitably colored as desired for attractiveness. A variety of exterior and interior ornamentation may be employed on the container, including embossed designs and decals, as desired.

Still other features and benefits of the invention will become evident as this description proceeds.

DESCRIPTION OF PREFERRED EMBODIMENT

Figure 1:
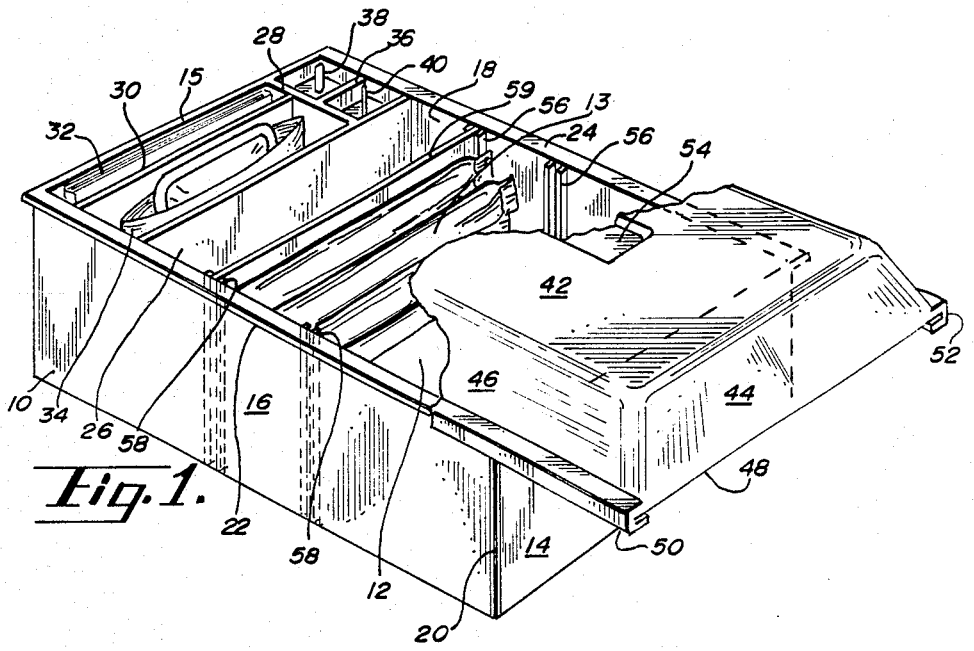
FIG. 1 is a schematic perspective view of one embodiment for the storage container of the invention, with parts broken away, illustrating compartmentalized storage of feminine supplies.

Referring first to FIG. 1, the feminine supplies storage container includes a base member 10 having a generally flat and substantially rectangular bottom panel (not marked by number in the drawing). Upright opposing end walls 14 and 15, and upright opposing side walls 16 and 18, are united to the bottom panel and merge into it. The end walls 14 and 15 and the side walls 16 and 18 are generally vertical or perpendicular to the bottom of the base member 10. The two side walls 16 and 18 are suitably perpendicular to the end walls 14 and 15 and are united at edges such as vertical edge 20. Outwardly extending from the upper horizontal perimeter edge of the side walls 16 and 18 are horizontal flanges 22 and 24.

The interior of base member 10 is divided by the primary fixed interior wall 26 which extends from side wall 16 to side wall 18. Wall 26 is substantially parallel to the opposing substantially parallel end walls 14 and 15. This primary fixed interior wall 26 divides the interior space of the base member into a larger first part 12 and a smaller part or portion which in turn is further subdivided to form specialized compartments for particular feminine supply items.

The larger first part 12 forms one partitionable compartment containing therewithin sanitary menstrual supply items 13. Optionally, this larger first part 12 may have its side walls equipped with vertical guideways 56 and 58 in opposing relationship on the interior of those side walls. The vertical guideways suitably are recesses formed either by parallel slat projections from the side walls as illustrated in FIG. 1 or by a simple vertical groove int the material of the side walls.

The smaller second part between end wall 15 and the primary fixed interior wall 26 is further subdivided into a plurality of even smaller compartments by interior subdivider walls. A first subdivider wall 28 extends perpendicular to the primary fixed interior wall 26 and is substantially closer to one of the side walls, namely side wall 18, than the other side wall 16, thereby dividing the smaller second part of the overall base member into a larger section and a smaller section. A second subdivider wall 30 extends parallel to the primary fixed interior wall 26 and divides the larger section into two compartments, one of which has therewithin a removable markable daily calendar 32 and the other of which has therewithin a removable contraceptive diaphragm in its envelope or special storage container 34.

Still further, a third subdivider wall 36 extends parallel to the primary fixed interior wall 26 and divides the smaller of the sections separated by the first subdivider wall 28 into two recesses, one of which contains a marking instrument 38 such as a pen or a pencil and the other of which contains a thermometer 40. To be observed is that all of these sections, recesses or compartments separated by subdivider walls in the smaller overall part of the base member of the container are appropriately sized for storage of the particular feminine items received therein. Further, the entirety of the base member 10 is molded as a unitary article preferably out of organic plastic such as, for example, polystyrene or any other suitably moldable plastic. If desired, a holder insert (not numbered) having an appropriately sized vertical bore or hole may be placed in the thermometer recess and in the marking instrument recess to maintain the thermometer or marking instrument in an upright position for ease of removal and replacement. The upper surface of the insert should be recessed well below the upper perimeter edge of the base member and at a level such that the pencil or pen and the thermometer, as received in the recesses for those items, will project above the insert for easy finger gripping. Lengthwise, the marking instrument should be equal to or less than the wall height of the base member 10 to allow for the easy slideability and removability of the cover without obstruction. The thermometer may be a bulb thermometer, a basal thermometer, or a digital thermometer, or equivalent. The date calendar for data-entry preferably is one of small size having monthly dates preferably over a full calendar year and having sufficient space around dates for small notations of temperature and other personal status. The sanitary menstrual supplies 13 in the larger part 12 suitable may include internal or external absorptive materials and structures as available on the market.

The preferred dimensions for the overall base member 10 may vary from about four to six to eight inches in height, from about six to eight to ten inches in length, and from about four to six or eight inches in width. The organized storage in the base member makes for compactness of overall size while accommodating all needed feminine use items for ready convenience.

The cover for the base has a rectangular perimeter closure edge 48 of sufficient overall dimensions to cover the uppermost edges of the side walls and end walls of the base member 10. Further, the cover has an upward generally concave interior recess such that portions spaced inwardly from the perimeter edge have an elevated height above the level of the cover perimeter edge 48. Extending upwardly from the perimeter edge of the cover are opposing cover side walls, only one of which is marked by 46 in FIG. 1, and upright cover end walls, only one of which is marked by 44 in FIG. 1. The cover side and end walls merge into or are united with top panel 42 of the cover. Panel 42 preferably carries a handle means 54 suitably formed by a molded depression or a molded projection at a central location in the top panel. Opposing track channels 50 and 52 of generally U-shaped contour are united to the lower perimeter edge of the side walls of the cover. The upper legs of the U-shaped track channels 50 and 52 suitably merge into o are part of the lower perimeter edge of the side panels. The upper legs of track channels rest upon opposing flanges 22 and 24 of the base member 10. The lower leg of the U-shaped track channels embraces the underside of the flanges 22 and 24 of the base 10. The opening of the U-shape extends inwardly for cooperatively embracing the outwardly extending flanges of the base 10 in a slidable relationship. The cover may be slid in either direction along the outwardly extending flanges of the base member to the full extent to remove the cover in its entirety from the base member.

The upward generally concave interior recess of the cover provides a significant benefit in that the larger first part 12 of the base member 10 may be stacked and even packed with sanitary menstrual supplies to a height well above the height of the side and end walls of the base member. This stacking or packing is easily accomplished with the cover in approximately the position illustrated in FIG. 1, or with the cover possibly slightly further slid toward the viewer. Sliding the cover back for full closure over the upper perimeter of the base 10, after stacking menstrual supplies above the height of the base 10 in the larger part 12, is easily accomplished. Thus the container can accomodate a relatively tall stack of menstrual care items while at the same time retaining convenience of the lower height for easy storage of items such as calendar, diaphragm, thermometer and marking instrument in the smaller part of the overall base member 10.

To be appreciated is that the larger first part 12 of the interior of the base member 10 created by the placement of primary interior wall 26 may be further subdivided by an optional removable subdivider panel or wall 59 resting in guideways 56 and 58. This may be done to provide a space configuration or added compartment more adaptable to particular sizes or different types of sanitary menstrual supplies, or to provide an additional compartment in the larger part 12 of the base for individually selected personal items.

Figure 2:
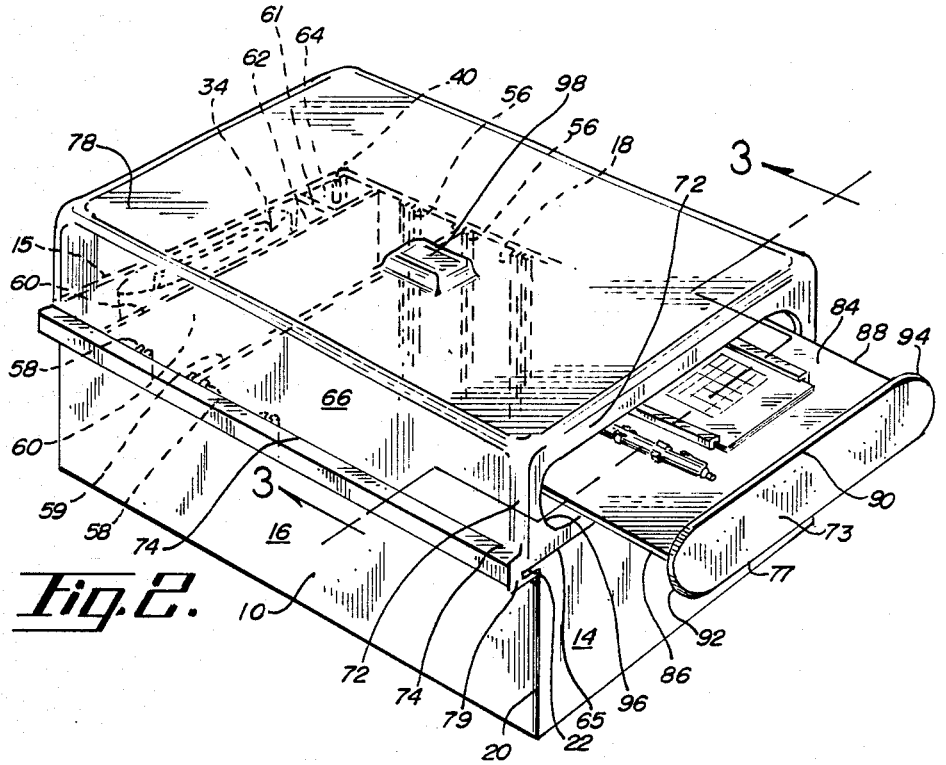
FIG. 2 is a schematic perspective view of an alternate embodiment for the storage container of the invention, particularly illustrating a tray member in the recess of the cover and its relationship to a movable wall portion of the cover, but omitting the means slidably mounting the tray in the cover so as to save clarity for the showing of the figure.
Figure 3:
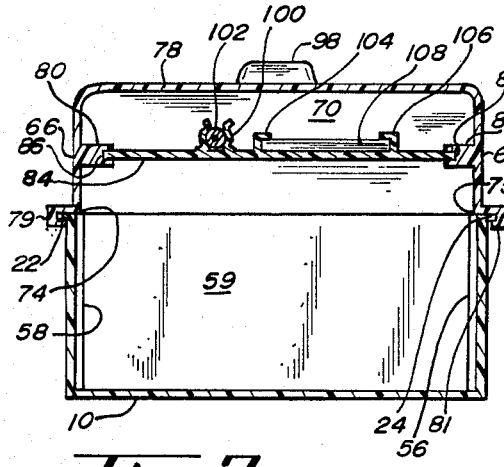
FIG. 3 is a detailed schematic cross-sectional view taken along line 3—3 of FIG. 2 and including the means slidably mounting the tray in the cover.
Figure 4:
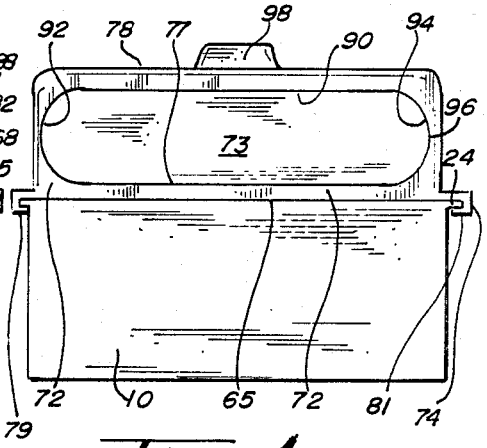
FIG. 4 is a schematic view of one end of the storage container of FIG. 2, particularly illustrating the symmetry of the movable wall portion.

Referring now to FIGS. 2, 3 and 4, a further embodiment of the invention will be described. In these figures, the illustrated base member is quite similar to the base member 10 in FIG. 1 and therefore elements of the base member 10 in FIGS. 2, 3 and 4 are given numbers common to those used in describing the base member 10 in FIG. 1, except in connection with the features of structure which are different and will now be described. The different feature of structure in the base 10 as illustrated in FIG. 2 is that the primary fixed interior wall 60 in FIG. 2 is much closer to the end wall 15 of the base than the primary fixed interior wall 26 is to the end wall 15 in FIG. 1. Additionally, the smaller part of the overall base separated by that primary fixed interior wall 60 from the larger part 12 of the base in FIG. 2 is divided by a first subdivider wall 61 extending perpendicular to the primary fixed interior wall 60 to form a larger section or recess 62 in which a diaphragm in its pocket 34 is stored and a smaller section 64 in which a thermometer 40 is stored. The remaining features of base 10 of FIGS. 2, 3 and 4 are entirely comparable to those described in FIG. 1.

The cover of the container in FIGS. 2, 3 and 4 has a lower perimeter closure edge 65 of sufficient overall dimensions to cover the uppermost edges of the side and end walls of the base member 10 and has an upwardly extending concave interior recess formed by upward cover walls consisting of opposing side walls 66 and 68 and opposing end walls 70 and 72. These opposing side and end walls extend upwardly from the perimeter closure edge 65 of the cover and are united to an upper panel or top panel 78 of the cover. A projecting external handle 98 centrally located on the outer top surface of the cover is preferably molded integrally with a top panel. One of the upwardly extending cover walls, namely cover end wall 72, as illustrated, has a removable wall portion 73. Remaining portions of that end wall 72 as well as the other end wall and the side walls of the cover are all integrally molded as a unit.

At the lower perimeter edge 74 and 75 of the cover side wall is united a track channel 79 and 81 of generally U-shaped contour as discussed in connection with the track channels 50 and 52 for FIG. 1. The lower edge 74 and 75 of the opposing side walls merges into the upper leg of the U-shaped track channels 79 and 81; and the U-shaped channels embrace the flanges 22 and 24 of the base member 10 in sliding relationship allowing complete removal of the cover from the base.

Referring particularly to FIGS. 2 and 4, the removable wall portion 73 has a perimeter edge of symmetrical design. Not only is the upper half a mirror image of the lower half of the removable wall portion, but also the right half is a mirror image of the left half of the removable wall portion. Optionally such symmetry may be avoided if desired; but significant benefits arise from having this perfect symmetrical design for the perimeter of the removable wall portion 73. Illustratively, the lower perimeter edge 77 and the upper perimeter edge 90 most preferably are horizontally straight lines, whereas the left perimeter edge 92 and the right perimeter edge 94 preferably are curved for the removable wall part 73. The symmetry permits the removable part 73 to mate with the opening of that end wall 72 regardless of whether the removable part 73 is inserted upside down or right side up. In either event, the perimeter of the removable portion always matches the edges of the opening in the cover wall 72 occupied by the removable wall portion 73. Within the upward recess of the cover are opposing parallel horizontally extending guide tracks 80 and 82 (see FIG. 3). These guide tracks are united to the interior of opposing cover walls 66 and 68. The guide tracks extend perpendicularly to the end cover wall 72 having the removable wall portion 73. To be observed is that the guide tracks are generally U-shaped in character and the legs of the U-shape project inwardly toward the interior of the cover from the cover walls. They project inwardly sufficiently to present a guide track capable of supporting a tray 84 of a width insertable through the wall opening for the removable wall part 73. The tray is equipped with opposing parallel edge structures 86 and 88 slidably mated with the U-shape of the opposing guide tracks. Further, the tray 84 is united to the removable wall portion 73 for sliding movement in the guide tracks 80 and 82. The relative vertical location of the guide tracks 80 and 82 and the tray relationship to wall part 73 are such that the tray itself may be inserted either uprightly or upside down while at the same time causing the perimeter of the removable wall portion 73, in either case, to always match the edges of the opening in the cover wall 72 occupied by that removable wall portion. It is of course evident that, for reversability (that is insertion of the tray either uprightly or upside down) and effective matching of the edges of the opening in the end wall 72 by the perimeter edges of the removable portion 73, the cover wall 72 and removable part 7 must be of vertical orientation and perpendicular to the horizontal guide tracks 80 and 82.

The cover tray 84 within the recess of the cover suitably may be equipped with a snap structure 100 formed of opposing resilient shapes more or less in the form of clips for removably holding a marking instrument 102. Additionally, the tray may be equipped with a retention structure illustratively consisting of upwardly and inwardly extending leg members 104 and 106 on opposing sides of a place for receiving a data-entry member such as a daily calendar 108. The tray within the concealed recess of the cover is not easily removed or slide out from the cover by any technique of finger gripping on the exterior surface. However, the tray is conveniently slidably moved outwardly from the cover by first sliding the entire cover along base member flanges 22 and 24 in the direction of the end wall of the cover carrying the removable wall part 73, and then inserting a finger underneath the edge 65 of the cover end wall 72 and lightly pressing against the interior surface of the removable wall part 73. Thus it is evident that the design illustrated in FIGS. 2, 3 and 4 is particularly useful for those desiring added security for privacy. Of course, if desired, a handle member (e.g. a knob or edge notch) may be added to removable part 73.

Figure 5:
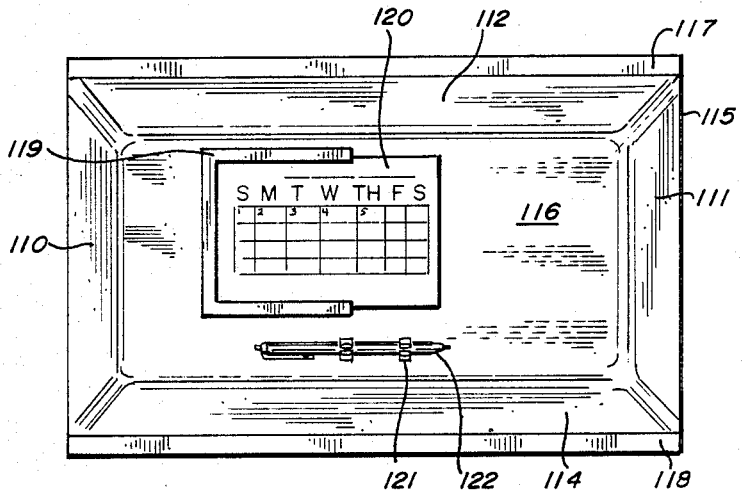
FIG. 5 is a schematic view looking upward into the interior recess of an alternate embodiment for the cover of the storage container of the invention.

Referring now to FIG. 5, the interior recess of the cover, as illustrated, is formed by upright sloping end walls 110 and 111 and upright sloping side walls 112 and 114. These walls extend up from the perimeter 115 of the cover and merge into the top panel 116 of the cover. The top panel is preferably a flat plane at least on its interior. U-shaped channels 117 and 118 at the side edges receive flanges 22 and 24 of a base member such as illustrated in FIGS. 1 or 2. Holders such as clips 121 on the interior surface of the top panel 116 removably receive a marking instrument such as a pen or pencil; and retention means 119 (suitably formed by inwardly directed leg members forming a groove) are provided for carrying a markable data-entry member 120 carrying calendar dates. Spaced opposing clips 121 suitably may be formed of thin plastic sufficiently resilient to snap-receive the marking instrument 122. The holder 119 retains the data-entry calendar in a manner permitting easy removal for writing on it.

A feature of the invention also is that the larger first part 12 which is optionally partitionable may be partitioned in a direction perpendicular to the illustrated partition 59 in FIG. 1. Thus the optional vertical partition wall for the larger part 12 may extend perpendicular to end wall 14. Also, if desired the track channels 56 and 58 may be removed and placed on the interior surfaces of the end wall 14 and the primary fixed wall 26 for reception of a divider panel or partition extending between them.

The invention may be embodied in other specific forms than those illustrated without departing from the spirit or essential characteristics thereof. For example, the base member may optionally incorporate designs and drawers, if desired, panels or walls may be slightly curved, or the intersections of panels and walls may be contoured. The illustrated embodiments are therefore to be considered in all respects as nonrestrictive, the scope of the invention being indicated by the appended claims rather than by the foregoing description; and all changes which come within the meaning and range of equivalency of the claims are therefore intended to be embraced thereby.

That which is claimed:

1. A partitioned and covered feminine supplies storage container, comprising:

a base member having a flat substantially rectangular bottom panel, opposing upright end walls and opposing upright side walls united to said bottom panel, each said side wall having an outwardly extending flange along the length of the uppermost edge thereof, a primary fixed interior wall parallel to said end walls and spaced in closer proximity to one of said end walls than to the other so as to divide the interior of said base member into a larger first part and a smaller second part, said larger first part being a partitionable compartment for sanitary menstrual supply items, and said smaller second part having a plurality of compartments formed by interior walls including a first subdivider wall perpendicular to said primary fixed interior wall to divide said smaller second part into a larger section and a smaller section, a second subdivider wall parallel to said primary fixed interior wall to divide said larger section into two compartments, one for a daily calendar and the other for a contraceptive diaphragm, and a third subdivider wall parallel to said primary fixed interior wall to divide said smaller section into two recesses, one for a marking instrument and the other for a thermometer, and a rectangular cover having a rectangular perimeter closure edge of sufficient dimensions to cover the uppermost edges of said side walls and said end walls of said base member, said cover having an upward generally concave interior recess such that portions spaced inwardly from said perimeter edge have an elevated height above the level of said perimeter edge, the perimeter edge having united to each side edge thereof a track channel of generally U-shaped contour with the opening of the U-shape extending inwardly and cooperatively embracing said outwardly extending flanges of said base member in a slidable relationship for sliding said cover in either direction along said outwardly extending flanges of said base member to the full extent to remove said cover in its entirety from said base member.

2. The container of claim 1 wherein said cover additionally has an external handle means integrally united at a central location on the outer top surface of said cover.

3. The container of claim 1 having vertical guideways in opposing relationship on the interior of said side walls of said partitionable compartment for receiving a slidably removable partition therein.

4. The container of claim 1 formed out of molded plastic.

5. A partitioned and covered feminine supplies storage container comprising:

a base member having a substantially flat rectangular bottom panel, opposing upright end walls and opposing upright side walls united to said bottom panel, each said side wall having an outwardly extending flange along the length of the uppermost edge thereof, a primary fixed interior wall spaced in closer proximity to one of said end walls than to the other to divide the interior of said base member into a larger first part and a smaller second part, said larger first part being one partitionable compartment for sanitary menstrual supply items, and said smaller second part having at least two compartments formed by a subdivider wall perpendicular to said primary fixed interior wall, and a rectangular cover having a perimeter closure edge of sufficient dimensions to cover the uppermost edges of the said side walls and said end walls of said base member, said cover having an upwardly generally concave interior recess formed by opposing side walls and opposing end walls extending upwardly from the perimeter closure edge of said cover and merging into an upper panel extending over the top of said cover, said upper panel having on the interior surface thereof at least one holder means for holding a feminine supply item within the concave interior recess of said cover, said cover having united to the opposing perimeter edge of each side wall thereof a track channel of generally U-shape contour with the opening of the U-shape extending inwardly and cooperatively embracing said outwardly extending flanges of said base member in a slidable relationship for sliding said cover in either direction along said outwardly extending flange of said base member to the full extent to remove said cover in its entirety from said base member.

6. The container of claim 5 including an external handle integrally united at a central location on the outer top surface of said cover.

7. The storage container of claim 5 wherein said upper panel holder comprises a snap grip structure.

8. The container of claim 5 wherein said upper panel holder means comprises spaced opposing leg members.

* * * * *